US011309672B2

(12) United States Patent
D'Addario et al.

(10) Patent No.: US 11,309,672 B2
(45) Date of Patent: Apr. 19, 2022

(54) SOLDER-LESS AND TOOL-LESS ELECTRICAL SYSTEM

(71) Applicant: D'Addario & Company, Inc., Farmingdale, NY (US)

(72) Inventors: James D'Addario, Old Westbury, NY (US); Andrzej J. Krol, Wayne, NJ (US); Zachary Stringham, New York, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 17/092,238

(22) Filed: Nov. 7, 2020

(65) Prior Publication Data

US 2021/0143594 A1 May 13, 2021

Related U.S. Application Data

(60) Provisional application No. 62/931,873, filed on Nov. 7, 2019.

(51) Int. Cl.

| | |
|---|---|
| ***H01R 4/24*** | (2018.01) |
| ***H01R 31/06*** | (2006.01) |
| ***H01R 13/717*** | (2006.01) |

(52) U.S. Cl.

CPC ..... *H01R 31/065* (2013.01); *H01R 13/717* (2013.01)

(58) Field of Classification Search

CPC .. H01R 4/2433; H01R 4/2429; H01R 4/2491; H01R 13/622

USPC ..... 439/404, 417, 393, 320, 395, 398

See application file for complete search history.

(56) References Cited

U.S. PATENT DOCUMENTS 10,135,207 B2 * 11/2018 Cui ..... H05K 1/181
2015/0099393 A1 * 4/2015 McGregor ..... H01R 4/2408 439/419

* cited by examiner

*Primary Examiner* — Phuong Chi Thi Nguyen
(74) *Attorney, Agent, or Firm* — Alix, Yale & Ristas, LLP

(57) ABSTRACT

An adjustable and reusable electrical assembly has an electrical unit, such as a plug unit or light unit, configured to engage with a cable. The electrical unit has a body that defines a channel connecting opposite pass-through openings. A first contact member and a second contact member are positioned with at least a portion in the body, each contact member having a piercing member. The cable is engageable with the plug unit extending through the channel with one piercing member in conductive contact with one wire and the other piercing member in conductive contact with the other wire. The cable can be disengaged from the plug unit and re-engaged at a different transverse position to change the length of the assembly.

20 Claims, 17 Drawing Sheets

SECTION A-A

SECTION A-A

SINGLE CABLE (PASS THROUGH) CONFIGURATION

FOLDED CABLE (END PLUG) CONFIGURATION

SINGLE CABLE (PASS THROUGH) CONFIGURATION

SECTION B-B
SCALE 3 : 1

FOLDED CABLE (END PLUG) CONFIGURATION

SECTION C-C
SCALE 3 : 1

SOLDER-LESS AND TOOL-LESS ELECTRICAL SYSTEM

CROSS-REFERENCE TO RELATED APPLICATION

This application claims priority to U.S. Provisional Patent Application No. 62/931,873 for "Solder-less and Tool-less Power Plug," filed Nov. 7, 2019, the entire contents of which are incorporated herein by reference.

BACKGROUND OF THE DISCLOSURE

The present disclosure relates to electrical systems. More particularly, the disclosure relates to electrical systems, such as power plugs or light units, that are customizable and reusable without requiring tools.

Power plugs and adapters are used with countless products and accessories to provide electrical signal from a power source to the product, including for example, in musical instrument amplification and effects accessories. These power cables are typically preformed molded standalone products with a one or more plugs positioned along an electrical cable at predetermined locations. Power plugs come in several varieties, including "home run" configuration, which provides a direct, isolated electrical signal from a main power source to an input at a product. Another variety of power plug configuration is known as a "daisy chain" configuration, which is a wiring scheme in which multiple plug units are wired together in sequence.

Most home run and daisy chain power plugs are preformed, molded units having predetermined finite cable lengths between plug units, requiring users to purchase different length plugs for different uses. In many environments, this results in excess cable between devices, which can be messy, aesthetically displeasing and in some cases hazardous. This is especially the case in certain contexts within which components or accessories are positioned very close and/or at inconsistent distances to one another.

One such context is in effects pedals used for altering the sound characteristics of instruments (usually electric guitars). Users mount multiple different effects pedals to a pedalboard that a guitarist or other instrumentalist may use to create various sound effects or alterations. All of the effects pedals on a board must be connected to a power supply (in addition to an audio signal connection), which often results in a messy bunch of tangled power cables.

Additionally, barrel jacks and plugs exist in male and female configurations to allow various connection options. Such barrel jacks also come in a variety of sizes, such as 6.4×4.4 mm, 6.3×3.0 mm, 5.5×2.5 mm, 5.5×2.1 mm, 5.5×1.7 mm, 4.0×1.7 mm and 3.5×1.35 mm.

Barrel plugs and jacks with different default polarities are used across many industries. For instance, in the music industry almost all guitar effects units utilize a "reverse" polarity with a sleeve carrying a positive connection and a tip carrying a negative connection. This is the opposite of many industries that use a "standard" polarity with a positive tip and negative sleeve. Some vintage, custom musical effects units have a standard polarity as well. This phenomenon can cause confusion and risk. If a user accidentally wires his cable with an opposite polarity from the wiring of the equipment, the equipment can be damaged upon connecting the cable since older effects units often do not have sophisticated circuit protection to detect incorrect polarity.

It would thus be useful to provide a power plug that can be easily customized in terms of cable length and electrical configuration and with components that can be reused. It would further be useful to provide a power plug within which the positive/negative polarity is easily identifiable and reversible. Finally, it would be useful to provide an electrical assembly or system for use within other contexts that is similarly adaptable and reusable.

SUMMARY

In one embodiment, an electrical assembly includes an elongate cable with two wires, an electrical unit and two contact members. The electrical unit has a body that defines a longitudinal axis and an elongate slot that extends transversely through opposite sides. A first contact member and a second contact member are independently positioned within at least a portion of the body. The cable is engageable by the electrical unit with the cable extending transversely through the elongate slot of the body and a first transverse section of the cable maintained within the body creating communicative contact between the first wire and first contact member and between the second wire and second contact member. The cable can be disengaged from the electrical unit and re-engaged by the electrical unit with the cable extending through the elongate slot of the body and a second transverse section of the cable maintained within the body creating communicative contact between the first wire and the first contact member and between the second wire and the second contact member.

In another embodiment, an electrical unit comprises a body with a first electrically conductive contact member and a second electrically conductive contact member. The body includes a tubular projection that extends longitudinally from a central section. A slot that extends transversely from a first pass though opening to a second pass-through opening with a channel extending therebetween. The first contact member is positioned within at least a portion of the body and has a first piercing member extending longitudinally into the channel. The second contact member is also positioned within at least a portion of the body and has a second piercing member extending longitudinally into the channel. The slot is configured to receive an elongate cable having two conductive wires within the channel with the cable extending transversely through the first pass-through opening and second pass-through opening and a first section of the cable within the housing. A longitudinal force on the cable causes the first piercing member into conductive contact with the first conductive wire to transmit a first charge through the first contact member and forces the second piercing member into conductive contact with the second conductive wire to transmit a second charge through the second contact member. The cable is releasable from the channel, thereby disengaging the first piercing member from the first wire and disengaging the second piercing member from the second wire. The cable is then repositionable extending transversely through the first pass-through opening and second pass-through opening with a second section transversely removed from the first section within the housing. A longitudinal force on the cable causes the first piercing member into conductive contact with the first conductive wire to transmit a first charge through the first contact member and forces the second piercing member into conductive contact with the second conductive wire to transmit a second charge through the second contact member.

In yet another embodiment, an electrical unit has a body, a first conductive contact member and a second conductive contact member. The body defines transversely opposite pass-through openings with a transverse channel extending therebetween. The first contact member has a first piercing member extending longitudinally into the channel, and the second contact member has a second piercing member extending longitudinally into the channel. The body is configured to receive a cable with a first wire and a second wire in a first position extending through the first pass-through opening and second pass-through opening with a first transverse section of the cable trapped within the channel. In the first position, the first piercing member is in conductive contact with the first wire and the second piercing member is in conductive contact with the second wire, which establishes a conductive pathway from the cable through the first and second contact members. The cable is removable from the first position and movable to a second position with a different second transverse section of the cable trapped within the channel and the first piercing member in conductive contact with the first wire and the second piercing member in conductive contact with the second wire, which establishes a conductive pathway from the cable through the first and second contact members.

In all embodiments, the cable jacket is formed of a material with a soft and flexible composition that "heals" itself via closing an earlier puncture hole, thereby providing necessary insulation and preventing a short circuit.

The disclosed embodiments may additionally include a color-coding system for identifying and optionally reversing polarity. For example, in one embodiment of the system, the cable wires are respectively black and red, and the electrical unit is marked red on one side. If the user has a standard effects unit with tip negative orientation, he or she can simply align the red wire with the red indicator side of the electrical unit to make the proper connection, or alternatively reverse the polarity by lining the black wire with the red indicator side on the electrical unit.

A particularly preferred embodiment of the disclosed electrical assembly is an adaptable power plug system with individual plug units that engage with a cable. However, the disclosed customizable connection system is adaptable to other contexts, such as decorative strings of relatively low voltage lights.

As will become evident from the herein description, the disclosed embodiments carry the following unique features not found in known power plugs:

- A do-it-yourself customizable solution that requires no tool to operate.
- Cables can be made in a daisy chain configuration or as home run connections back to a master power supply.
- Plugs can easily be reused and moved from one location to a new location on the cable without having to discard the cable.
- Allows customization for neat and orderly connection of power to all pedals on an effects pedal board.
- Includes a simple color-coding system that enables connection polarity to be easily reversed between tip positive/ring negative and ring positive/tip negative to accommodate any polarity requirement.

BRIEF DESCRIPTION OF THE DRAWINGS

Aspects of the preferred embodiment will be described in reference to the drawings, where like numerals reflect like elements.

DETAILED DESCRIPTION

Among the benefits and improvements disclosed herein, other objects and advantages of the disclosed embodiments will become apparent from the following wherein like numerals represent like parts throughout the several figures. Detailed embodiments of an electrical assembly, such as a power plug or light unit, that is customizable and adjustable without the necessity of soldering or tools are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

With reference to the drawings wherein like numerals represent like parts throughout the Figures, the inventive customizable electrical assembly in the form of a plug generally includes a plug unit 10/110 and cable C. While FIGS. 1-15 show the electrical assembly power plugs and FIGS. 16-19 show the electrical assembly as light units, it is understood that the unique elements, relationships and overall concepts that impart customizability and reusability can be incorporated into numerous alternative electrical units.

Figure 1:
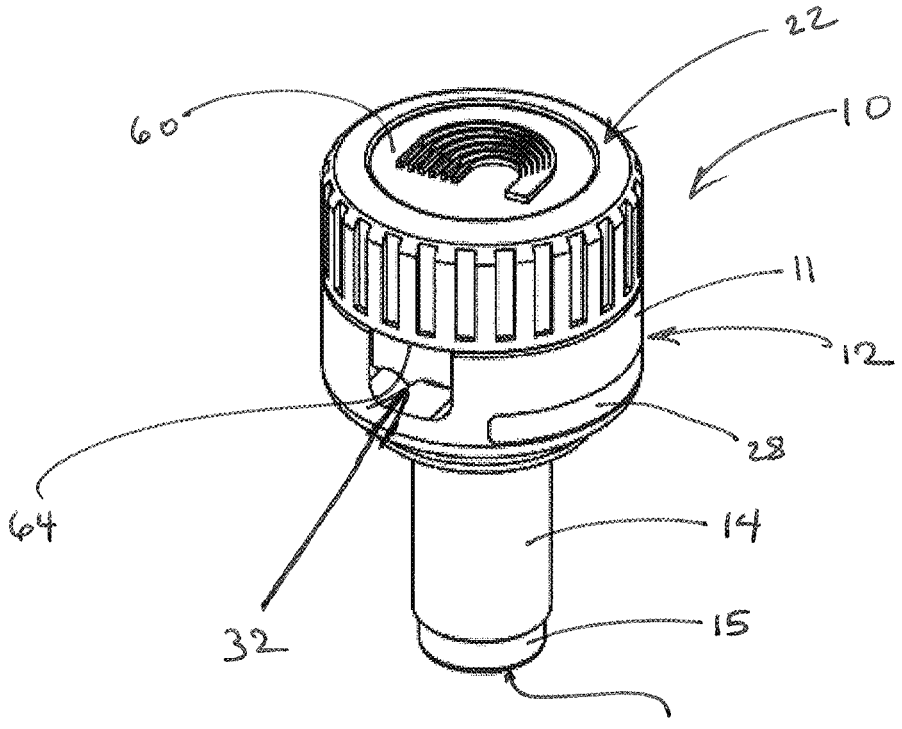
FIG. 1 is a perspective view of an embodiment of a male power plug according to the disclosure.
Figure 2:
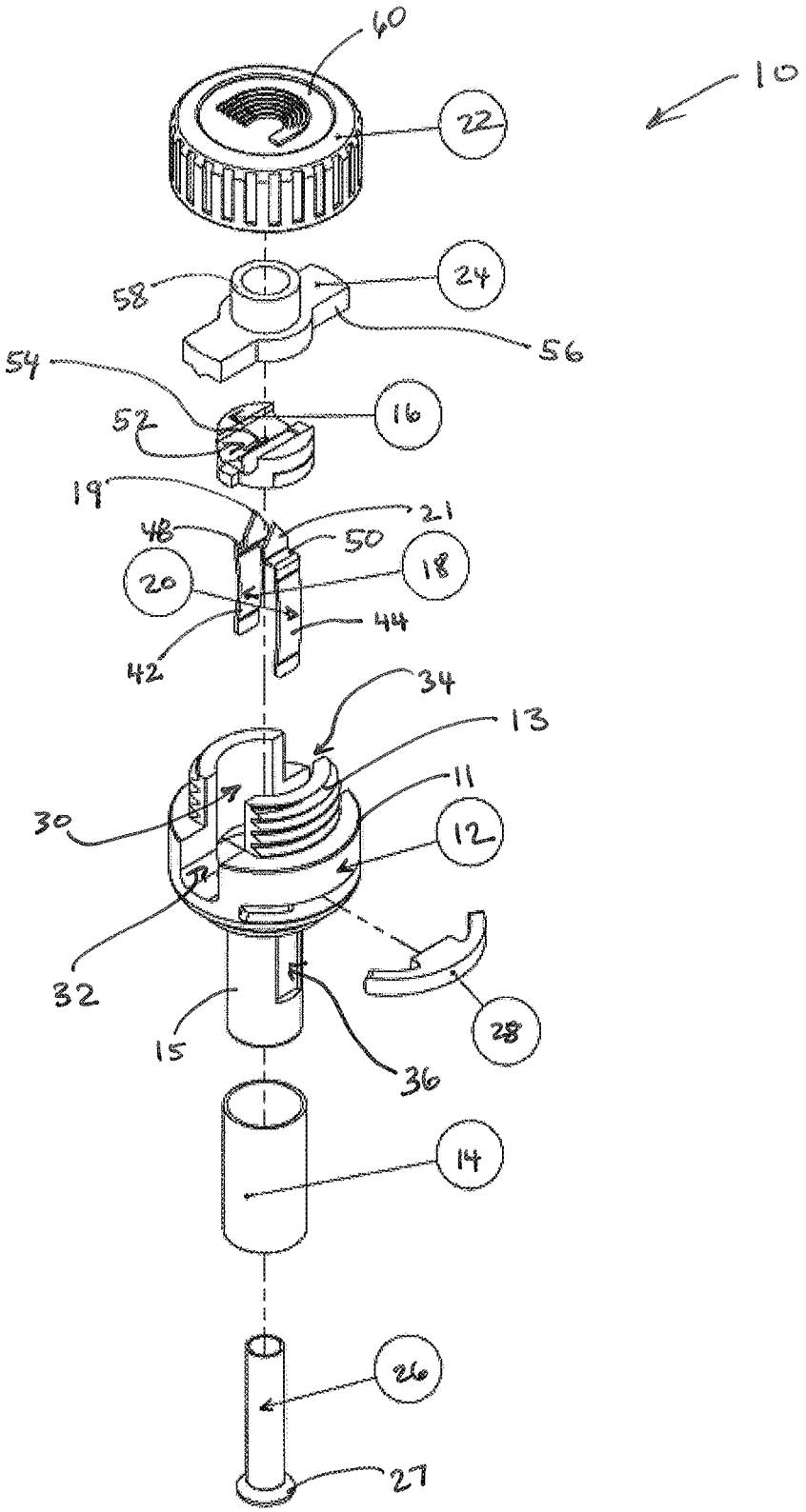
FIG. 2 is an exploded view of the power plug of FIG. 1.
Figure 3:
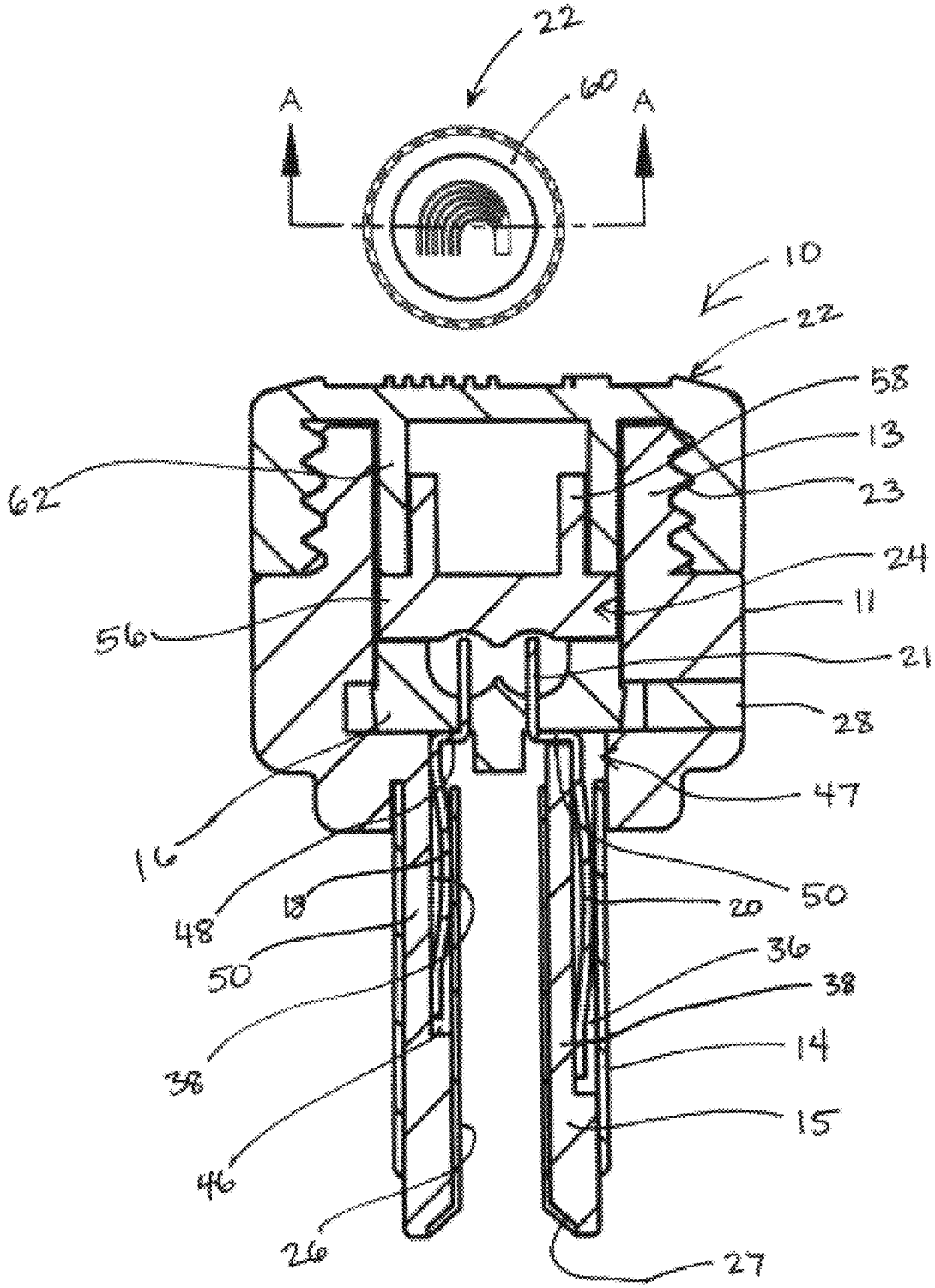
FIG. 3 is a top view and section view of the power plug of FIG. 1.
Figure 4:
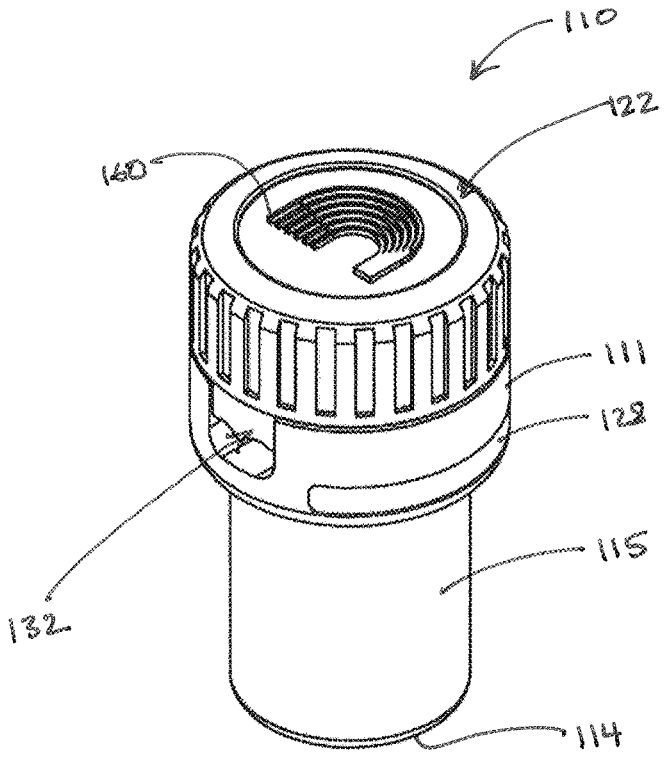
FIG. 4 is a perspective view of an embodiment of a female power plug according to the disclosure.
Figure 5:
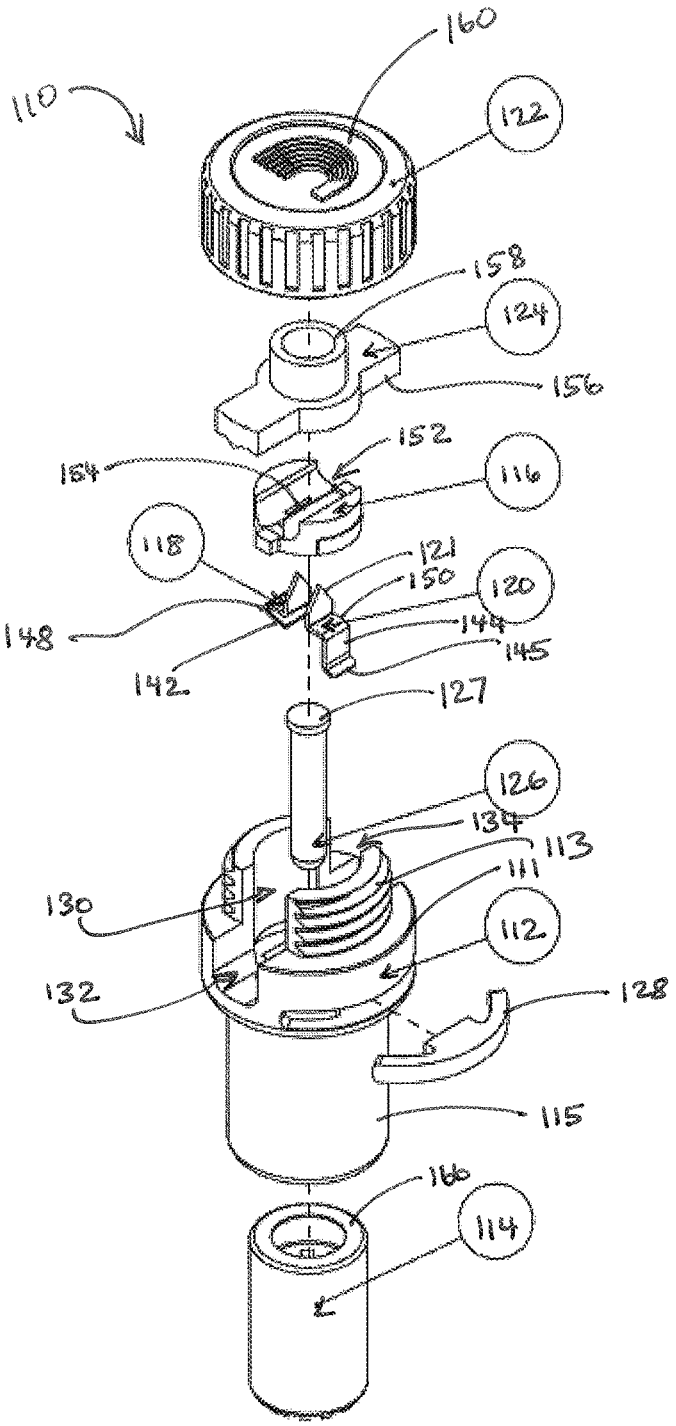
FIG. 5 is an exploded view of the power plug of FIG. 4.

A first embodiment of a male power plug unit 10 is shown in FIGS. 1-3. The plug unit 10 includes a body 12 with an upper threaded section 13, central section 11 and lower tubular projection 15 that defines a longitudinal axis of the plug 10. An elongate slot 30 extends longitudinally through the upper threaded section 13, partially through the central section 11, and transversely through opposite sides to define radially opposite pass-through openings, 32 and 34. The central section 11 defines a side slot that maintains an insert 28 for identifying the positive or negative charge side (i.e., to identify the positive charge side, the insert is a red colored member or includes some other indication of positive charge).

The positive side of the body tube 15 has an inner wall section 38 and defines an axially elongate slot 36 that is open to the outside. The negative side of the body tube 15 has an outer wall section 40 with an inner notch 46 that is open to the inner side of the body tube. A negative inner tube 26 carries a terminal flange 27 and is generally sized and shaped to fit tightly within the body tube 15, which can be seen most clearly in the section view of FIG. 3. A positive outer tube 14 is sized and shaped to fit tightly around the outside of the body tube 15.

A first (negative) contact member 18 comprises a lower contact leg 42 that transitions to an upper piercing member 19 via a compound bend 48. The lower contact leg 42 is bowed such that it has a convex surface toward the open inner area of the negative side of the body tube 15. A second (positive) contact member 20 has a similar configuration to the negative contact member 18, with a lower contact leg 44 that transitions to an upper positive piercing member 21 via a compound bend 50. The lower positive leg 44 is bowed with a convex surface toward the open outer area of the positive side of the body tube 15. As shown, both the positive and negative contact members are flat metallic sheets or leaves. As can be seen in the Figures, in this embodiment, the first and second piercing members, 19 and 21, are formed as prongs on upper ends of the first contact member and the second contact member. However, alternative piercing members exist, including pins, hooks, claws or similar elements configured to penetrate the insulating jacket of a cable and conductively contact the underlying wire.

The plug 10 also includes an inner insulator 16 shaped to be received within the central section 11 of the body 12. The inner insulator 16 is disc-shaped with a transverse slot 52 extending axially through the top surface and laterally through opposite radial sides. When engaged within the body 12, the insulator slot 52 aligns with the body slot 30 such that they cooperate to form a pass-through channel for receipt of a cable C with respective positive and negative wires. As depicted, preferably, the inner insulator 16 includes a pair of opposite tabs for assisting proper alignment within the body, and a surface contour within the slot 52 that is sized and shaped to cradle the respective positive and negative wires, when inserted. The inner insulator 16 also defines an axial slot 54 through which the negative piercing member 19 extends longitudinally and a comparable axial slot (not shown in FIG. 2) for the positive piercing member 21.

With reference to FIG. 3, when assembled, the negative contact member 18 is positioned with its leg 42 in the pathway 46 of the negative side of the body tube 15 with the convex leg surface exposed to the inner section of the body tube and the negative piercing member 19 extending through the axial slot 54 of the inner insulator 16. Similarly, the positive contact member 20 is positioned with its leg 44 in the outer pathway 47 in the positive side of the body tube 15 and the convex leg surface exposed to the outer area of the body tube and the positive piercing member 21 extending through the positive axial slot of the inner insulator 16. As can be seen in FIG. 3, the bends, 48 and 50, in the respective negative contact and positive contact serve as an abutment surface against the bottom surface of the inner insulator 16.

The plug unit 10 also includes a removable insert 24 for use when engaging cables in a passthrough configuration, as will be described in detail below. With reference primarily to FIGS. 2 and 3, the insert 24 includes an elongate body 56 and a central cylindrical projection 58 extending upward from the body. The plug unit 10 also includes a cap 22 with a closed top 60 and a cylindrical wall extending from the top to a bottom edge 64. The cylindrical wall has inner threads 23 that mate with the outer threads 13 of the upper section of the plug body. A hollow central cylindrical wall 62 extends downward from the cap top 60 and is radially spaced from the inner threaded wall 23 to form an annular cavity sized and shaped to closely correspond to the upper section 13 of the plug body, which is best seen in the cross-sectional view of FIG. 3. As also shown in FIG. 3, the hollow central cylindrical wall is sized to accommodate the cylindrical projection 58 of the insert 24 when installed.

When the plug unit 10 is assembled, the negative contact member 18 provides an electrical pathway from its piercing member 19 positioned within the inner area of the body central section 11 and insulator 16 to the negative inner tube 26 through the negative lower leg 42. Similarly, the positive contact member 20 provides an electrical pathway from its piercing member 21 positioned within the inner area of the body central section 11 and insulator 16 to the positive outer tube 14 through the positive lower leg 44.

The plug body 12, inner insulator 16, cap 22 and insert 24 are all formed from insulating materials, while the contact members, 18 and 20, and the inner and outer tubes, 14 and 26, are formed of conductive materials. For example, the insulating elements can be formed of a thermoplastic or other polymeric material, with particularly preferred embodiments being formed of polyoxymethylene (POM). The conductive elements can be formed of a metallic material, such as copper, brass or combinations thereof. In a preferred embodiment, the contact members, 18 and 20, are formed of tempered beryllium copper and the tubes, 14 and 26, are formed of brass.

FIGS. 4-6, 9 and 10 depict another embodiment of a plug unit 110 with "female" plug elements. As can be seen in the drawings, the female plug unit 110 shares many common elements and relationships with the male plug unit 10. The female plug assembly utilizes a substantially identical insert 124, inner insulator 116, and cap 122 that cooperate in the same manner as the like elements of the male plug unit 10.

Additionally, the body 112 includes a substantially identical upper threaded section 113 and central section 111, however, with a lower tubular section 115 having a larger diameter to coincide with specifications for a female plug. The body 115 can also include one or more side slots for holding an insert 128 to identify positive or negative charge side for insertion of the cable. In the depicted embodiment, the insert 128 identifies the positive side and may be a red colored member. The lower tubular section 115 defines a longitudinal axis of the plug 110 and the body 112 includes an opening on the axis through which an inner negative pin 126 extends. A positive contact tube 114 is received within the lower tubular section 115 against the inner wall and spaced from the negative pin 126. The positive contact tube 114 can include a series of bowed sections 117 (see FIG. 10) along its inner circumference and an inwardly extending upper annular flange 166.

Figure 6:
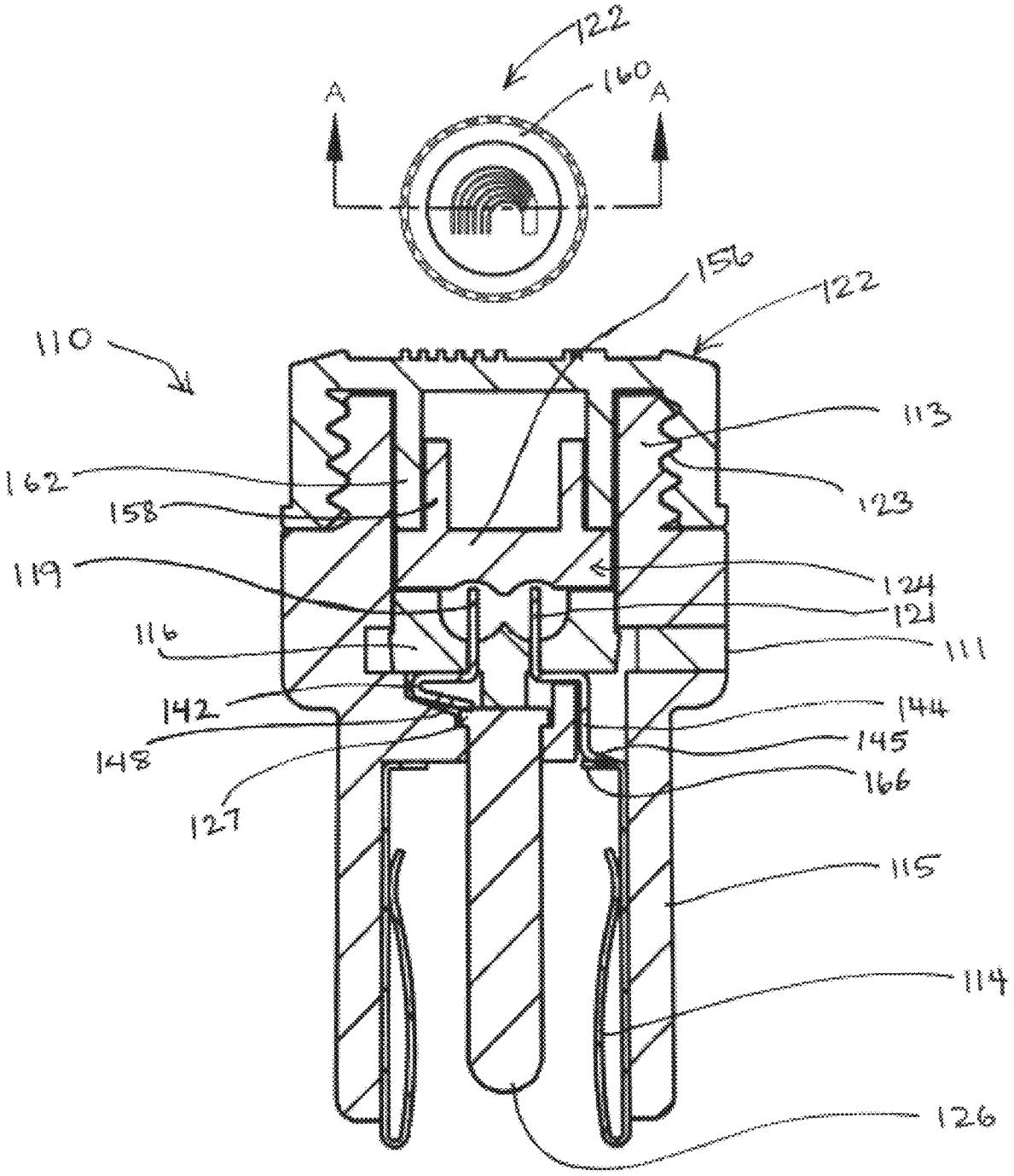
FIG. 6 is a top view and section view of the power plug of FIG. 4.

A negative contact member 118 carries an upper piercing member 119 that transitions to a lower leg 142 via an acutely angled bend 148. As shown in FIG. 6, when assembled, the lower leg 142 terminates within the housing 112 and abuts an upper flange 127 of the central pin 126, thereby establishing an electrical pathway for negative charge from the prong through the pin. A positive contact member 120 has an upper piercing member 121 and extends via a compound bend 150 to a lower leg 144 that carries a foot 145 that abuts the annular flange 166 of the positive contact tube 114. Like the earlier embodiment of the male plug 10, the respective piercing members, 119 and 121, are positioned axially within the inner insulator 116 in the central section of the body 112. As shown, the negative contact member 118 and central pin 126 remain in their respective positions spaced and insulated from the negative contact member 120 and positive tube 114 via the inner configuration of the housing and the inner insulator.

The disclosed embodiments of the plug units, 10 and 110, with removable screw cap 22/122 and other cooperative elements are configured to receive a power zip cable C (see FIG. 13) with negative wire 90 and positive wire 92 to form a respective plug 10/110. The cable C is aligned within the housing 12/112 in a position to be pierced by the respective negative piercing member (19/119)/positive piercing member (21/121) in a fully adaptable and reusable power plug system. A user can open the plug 10/110 by removing the cap (and insert 24/124, if applicable), insert the cable C from the top via the elongate slot 30/130 extending through the pass-through openings 32/34/132/134 at any desired transverse position along the cable C, and then tighten the screw cap 22/122 to make an electrical connection through the prongs of the contact members. When assembled, the downward force via the cap tightening presses down on the insert 24, when present, and causes the prongs to pierce the outer jackets of the wires 90 and 92 and contact the conductive inner wire.

Examples of the utility of the plug assemblies 10/110 will be described further with use of the reference numerals from the male plug 10 for simplicity. However, it is understood that the embodiments and features described below are fully applicable to the female plug 110 as well.

Figure 7:
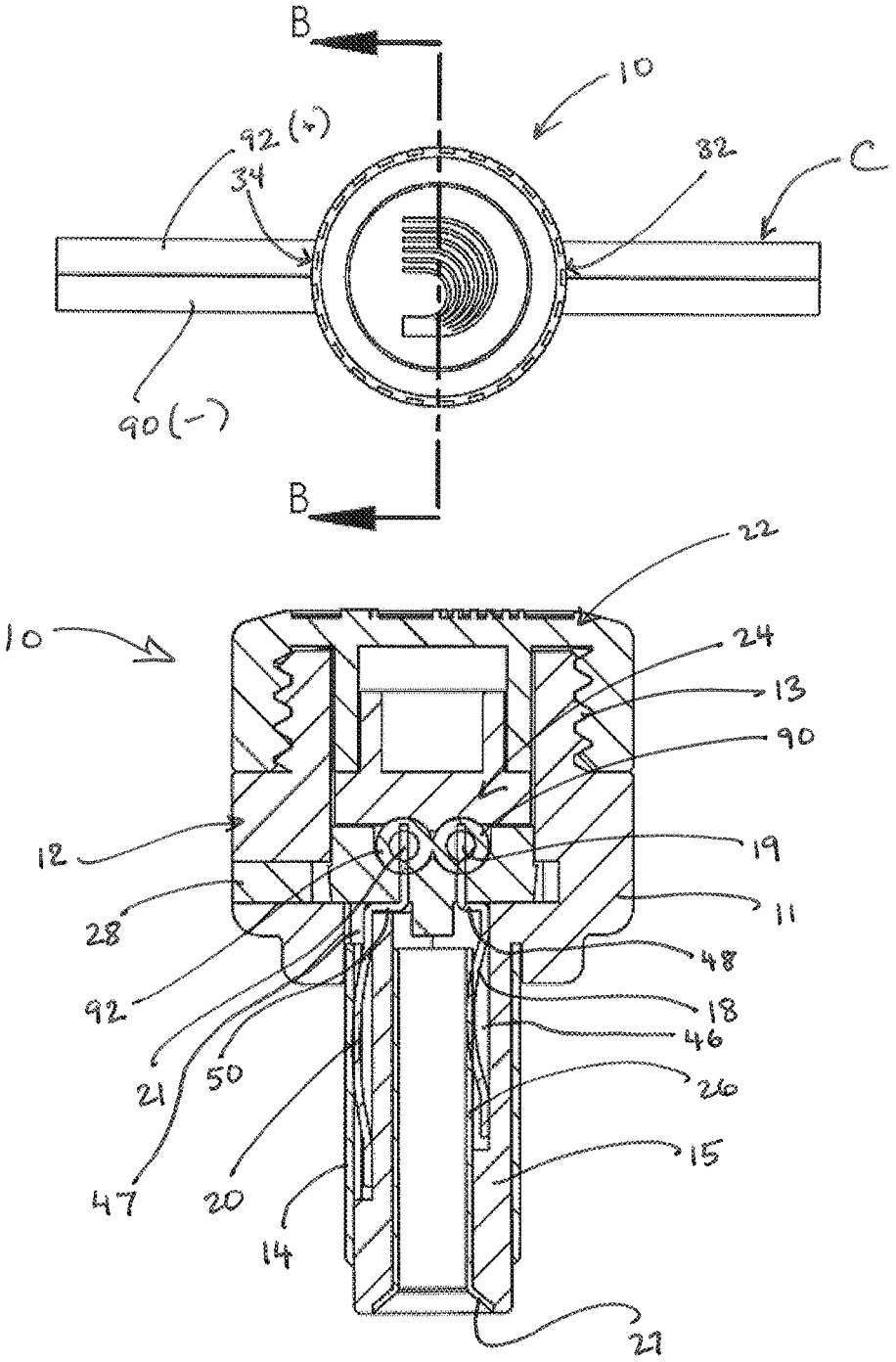
FIG. 7 is a top view and section view of the male plug of FIG. 1 with cable engaged in passthrough (single cable) configuration.

First, FIG. 7 generally depicts a plug 10 engaged with a cable C in a passthrough configuration. In this configuration, the cable C is received within the body 12 extending out from the opposite pass-through openings, 32 and 34. A user can position the plug 10 at any transverse position along the cable C to customize the length of the electrical cable as desired. In the passthrough configuration, the insert 24 is mounted in position within the body 12 laying on top of the cable C, and then the cap 22 is tightened via threading with the upper section 13 of the body 12. The cap 22 and insert 24 are not threaded or otherwise rotationally mated to one another, which allows the cap to rotate independent of the insert (and engaged cable C). As the cap 22 is tightened, its bottom edge 64 forces the insert 24 downward, causing the cable C to be sandwiched tightly with the negative wire 90 pierced by the negative piercing member 19 and the positive wire 92 pierced by the positive piercing member 92, as shown in the bottom drawing of FIG. 7.

Figure 8:
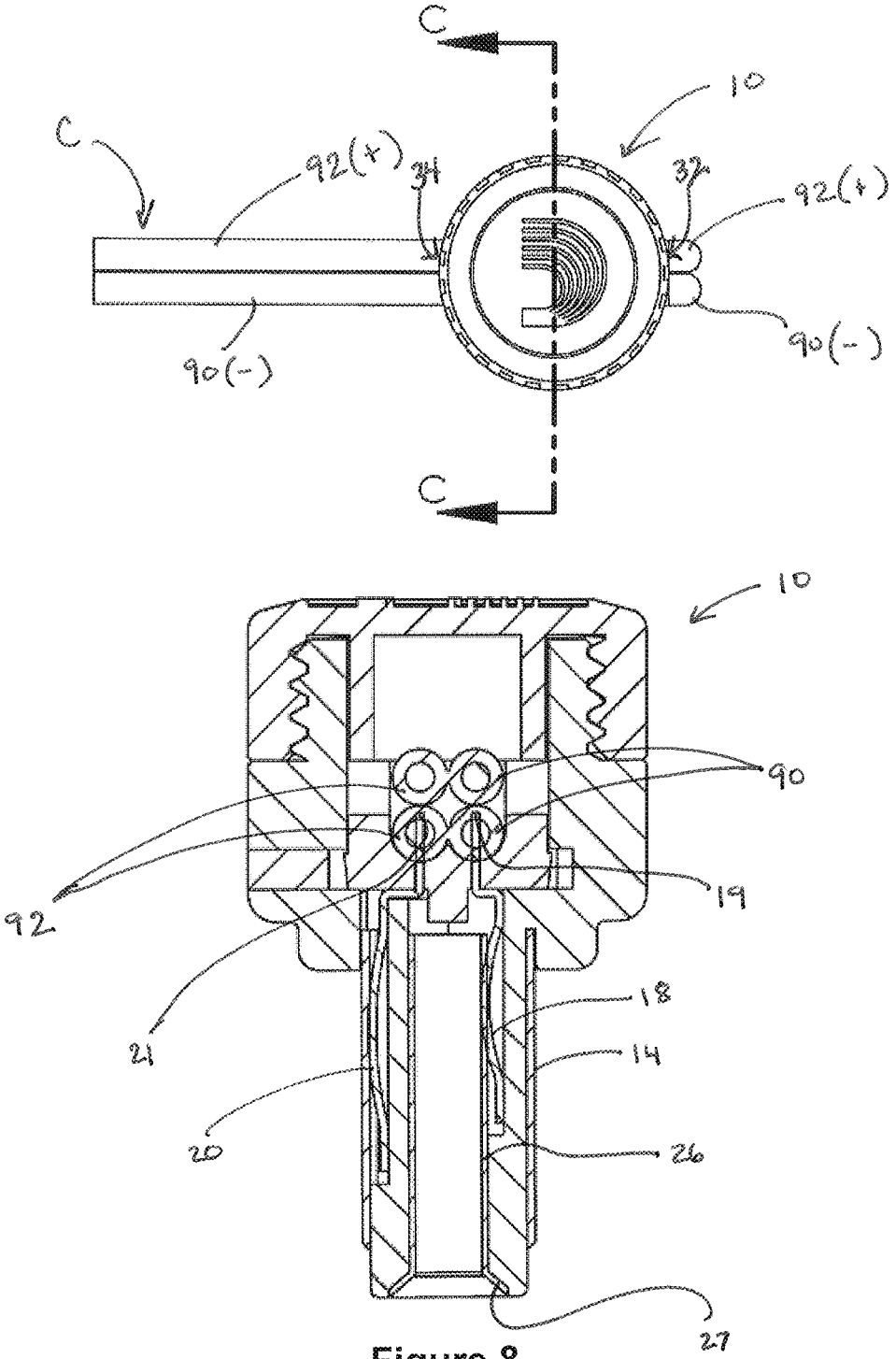
FIG. 8 is a top view and section view of the male plug of FIG. 1 with cable engaged in end plug (folded) configuration.
Figure 9:
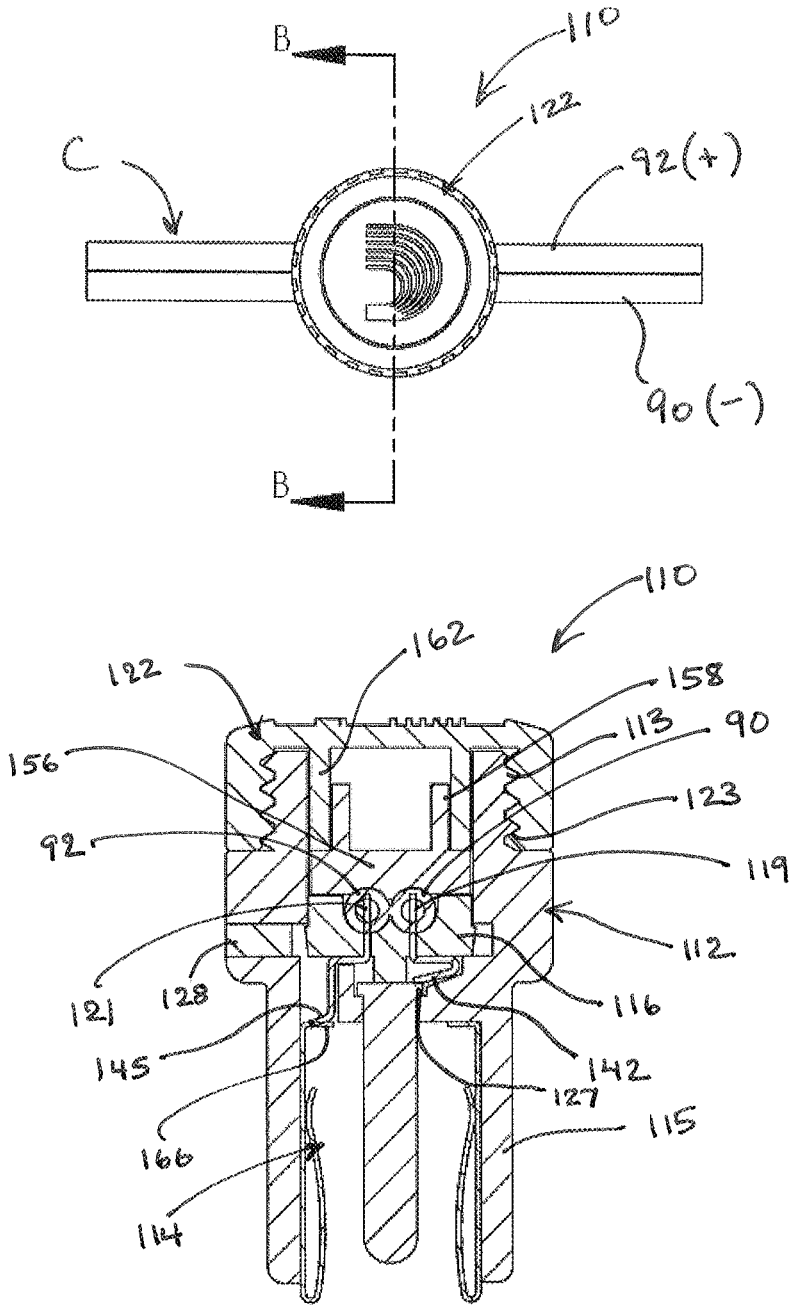
FIG. 9 is a top view and section view of the female plug of FIG. 1 with cable engaged in passthrough (single cable) configuration.
Figure 10:
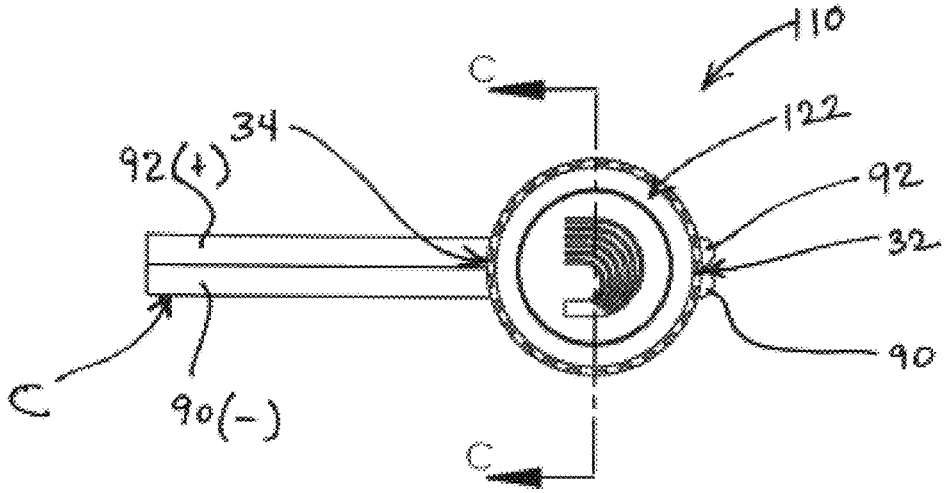
FIG. 10 is a top view and section view of the female plug of FIG. 1 with cable engaged in end plug (folded) configuration.
Figure 10:
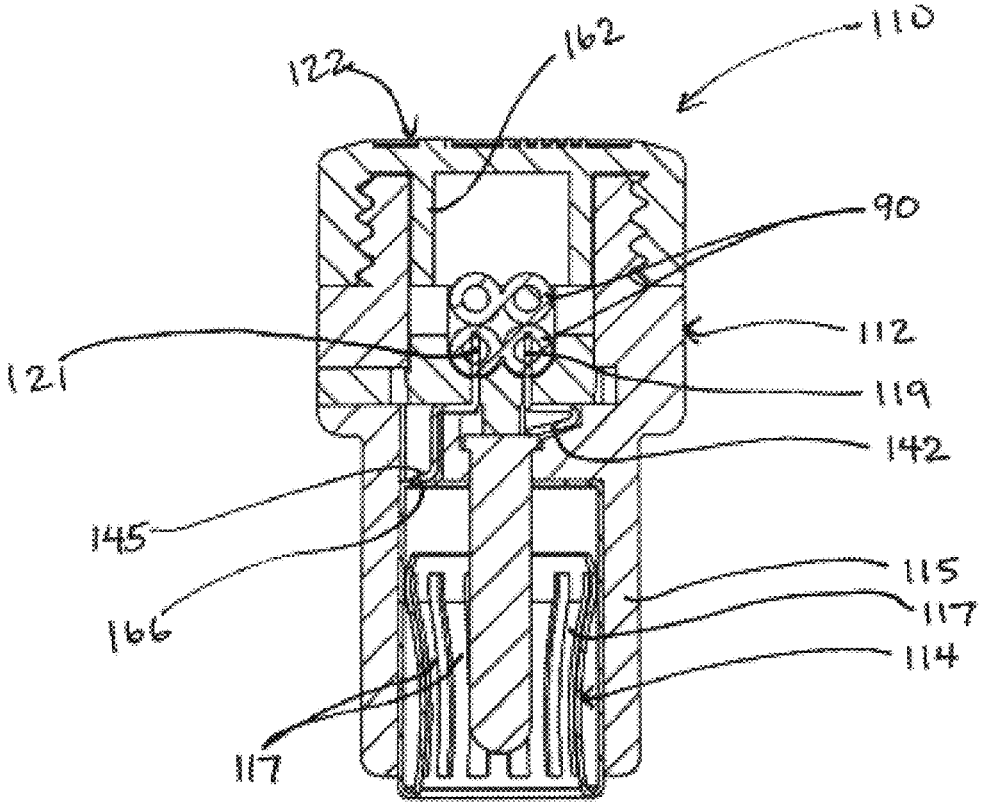

FIG. 8 depicts the plug unit 10 in a folded cable configuration, utilized for end plugs in a series. In this configuration, the cable C extends in a first direction through the pass-through opening 34, out from the opposite pass-through opening 32 and is then folded back into the interior of the body 12 in a stacked arrangement with proximal portion of the cable. The cap 22 is attached and tightened to the body 12 via the threaded engagement without use of the insert 24. The bottom edge 64 of the cap directly abuts the top (distal) portion of the folded cable C with the terminal ends of the wires concealed within the body 12 to secure the cable within the plug 10. As discussed above, the plug units 10 and 110 include a side marking or color insert 28/128 to identify the positive (and/or negative) side for correct alignment of the wires 90 and 92 within the housing.

Figure 11:
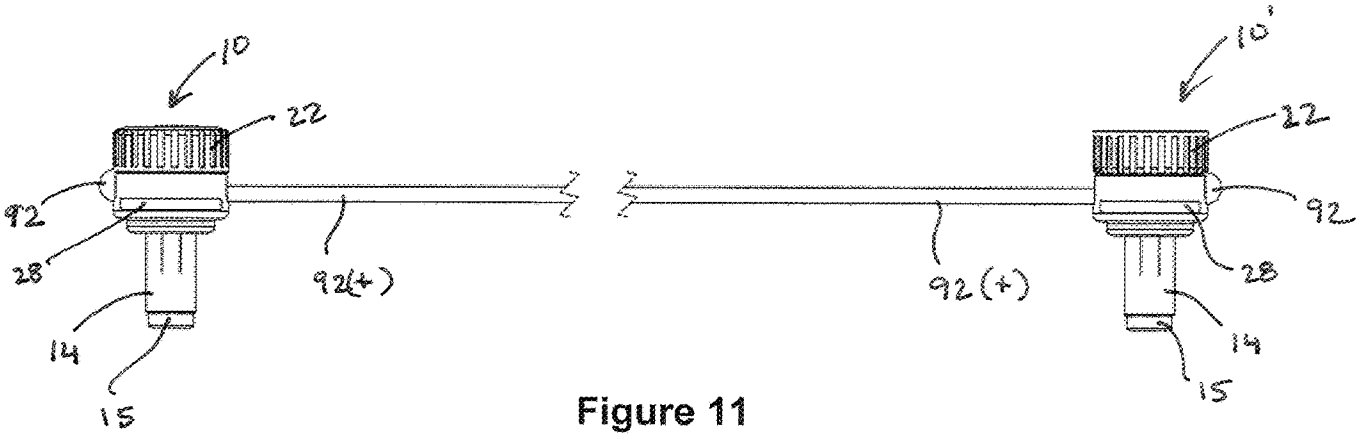
FIG. 11 depicts a representation of the inventive plugs engaged with electrical cable in a home run configuration.
Figure 12:
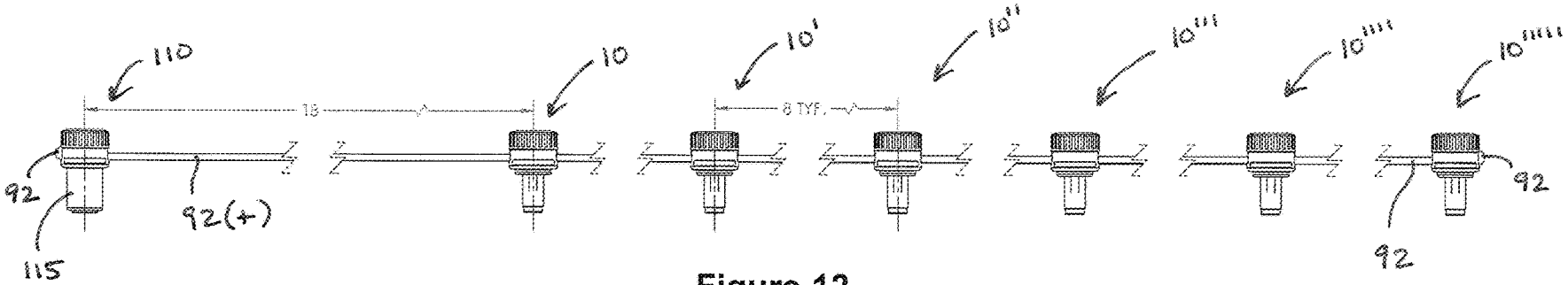
FIG. 12 depicts a representation of the inventive plugs engaged with electrical cable in a daisy chain configuration.
Figure 13:
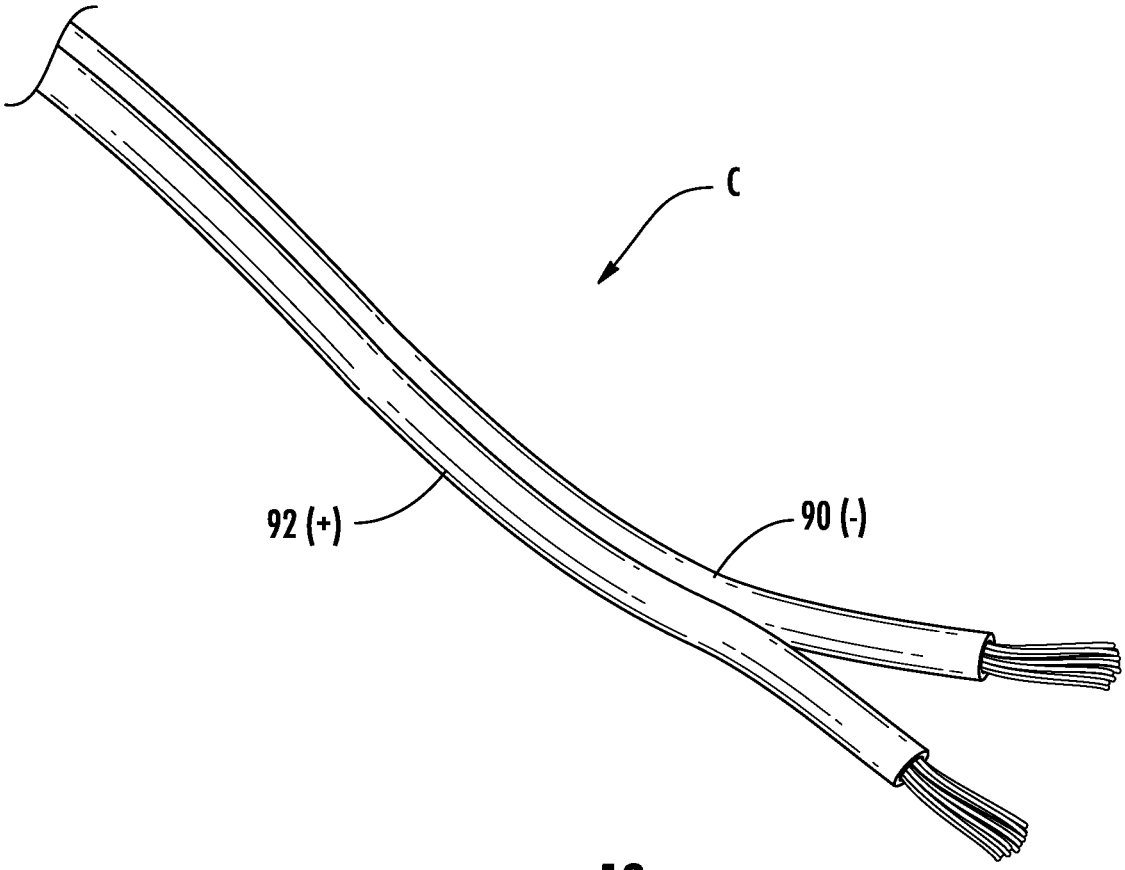
FIG. 13 shows an exemplary power zip cable for use within the plug system.

The disclosed customizable plug assemblies allow customized power cables to be made in both a daisy chain configuration (FIG. 12) or as home run connections back to a master power supply (FIG. 11). The disclosed embodiments are significantly improved over known daisy chain power cables that are typically pre-made, molded daisy chain power cables with excess wire between each plug that can tangle or interfere or must be tied up. Further, in some cases with existing cables, there is insufficient length between successive plugs for the desired use. The disclosed plugs, 10 and 110, allow users to create custom home run and daisy chain applications or any combination thereof. FIG. 12 is a depiction of an assembled plug showing a female end plug unit 110 for connection to a power source and six male plugs in daisy chain configuration.

In addition to the customizability offered by the disclosed embodiments, plug units 10/110 can be reused, and moved from one location along a cable to a new location on the cable without having to discard the cable. The power cable C itself has a soft outer insulation jacket around the positive and negative wires. The jacket is typically formed of a soft elastomer, such as PVC, allowing a user to relocate a plug along a daisy chain or shorten a home run cable simply by unscrewing the cap, moving the plug to a new location and reattaching the cap. The soft outer insulation closes and "heals" itself in the area where the plug was originally connected. This allows reuse of both the cable and plug elements.

In a particularly preferred use context within a pedalboard on which multiple effects pedals for guitars are mounted, the inventive plugs and cable allow for clean and neat power connection to all pedals on an effects pedal board without any undesired excess cable between pedals. The system allows the user to make customized power plugs to yield an orderly and clean installation of all power connections and avoid having to tie up excess cable between each effects pedal. The male and female signal elements depicted in the drawings are the most preferred embodiments as they are commonly used for powering guitar effects pedals and similar accessories. However, it is understood that the inventive concepts and features of the customizable plug system disclosed herein are not limited in this manner and can be adapted to provide plug units with a wide variety of signal connectors.

Modern pedals for musical instrument effects are typically wired to be powered via a plug with negative charge in the center of the plug unit and positive charge to the outer tube (a "standard pedal"), which corresponds to the primary configuration of the inventive embodiments of the plugs described above. However, some effects pedals, typically older pedals, exist with reversed polarity (i.e., with plugs having negative outer tube and positive center; a "vintage pedal"). For powering a standard pedal, the user can wire the disclosed plug unit 10/110 the common way described above by simply matching the color coded side of the plug (identified by the insert 28/128) to the color or other +/− identifier of the wires, 90 and 92, in the cable C. If the user wishes to reverse the polarity of the plug to accommodate a vintage pedal, the can simply flip the cable C relative to the plug body to reverse the +/− connection (i.e., connect the positive wire 92 to the first (negative) piercing member 19/119 and the negative wire 90 to the second (positive) piercing member 21/121).

Reversing the polarity of the plug as described in the preceding paragraph carries a potential risk in that accidental connection of a reverse wired plug to a standard effects pedal or other device (or connecting a standard wired plug to a vintage pedal) may damage the circuitry. Thus, some embodiments of the plugs include an LED test circuit in the plug unit to notify whether the plug is connected in a standard wiring or reversed polarity. The circuitry is additionally usable as a pilot notification to test whether a particular plug and daisy chain is working properly.

Figure 14:
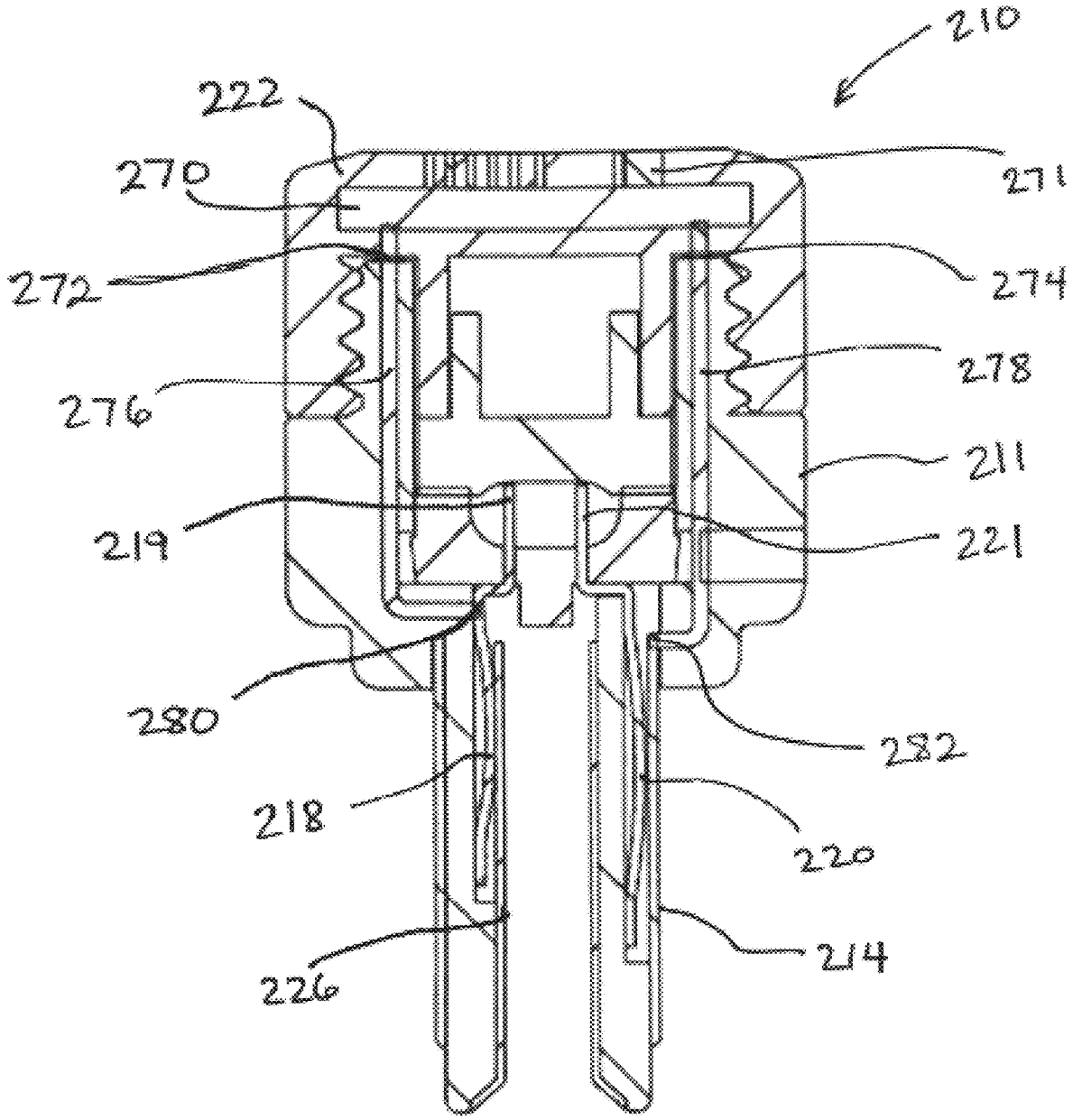
FIG. 14 is a cross-section of a plug unit with tracings for a test pilot circuit.

FIG. 14 shows a plug unit 210 with an example of such circuitry that provides a dual-color LED notification that serves as a pilot light and polarity indicator. As shown, a PCB 270 with dual-color LED is mounted within the cap 222 with a lens or window 271 that allows light from the LED to be viewable on the outside. Reference numerals 272 and 274 represent electrical contact points between the cap 222 and body 212. The plug unit 210 includes a negative trace 276 and positive trace 278 over-molded into the cap 212. The negative trace 276 contacts the negative contact member 218 at point 280 to form an electrical path through all "negative" members to the PCB 270. Similarly, the positive trace 278 is in contact with the positive outer tube 214 at point 282 to form an electrical path through all "positive" member to the PCB board 270. The particular points of contact between the traces, 276 and 278, and the other elements depicted in FIG. 14 are non-limiting, so long as the PCB maintains contact with each of the positive and negative electrical pathways. Additionally, the PCB may include multiple LEDs in place of the dual-color LED.

Figure 15:
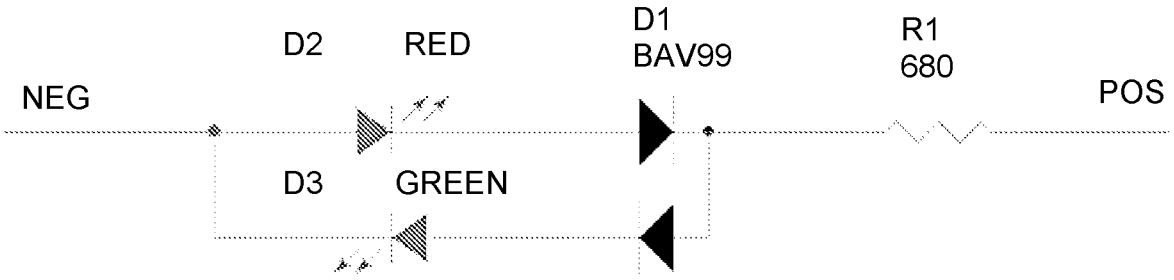
FIG. 15 shows an exemplary test circuit for use in the plug unit of FIG. 14.

The circuit illuminates the LED in a first color (i.e., green) if the plug is functioning correctly and wired with the standard polarity—negative wire 90 connected via negative piercing member 219 and positive wire 92 connected via positive piercing member 221. If the plug is wired with reverse polarity and functioning correctly—negative wire 90 connected via positive piercing member 221 and positive wire 92 connected via negative piercing member 219, the LED is illuminated in a different color (i.e., red). If the plug is not conducting properly, for example, one or both of the wires is not pierced by a respective piercing member, the LED would not illuminate at all. FIG. 15 shows an exemplary circuit that uses of a one-way diode D1 to affect the alternate illumination of the LED (red or green).

Figure 16:
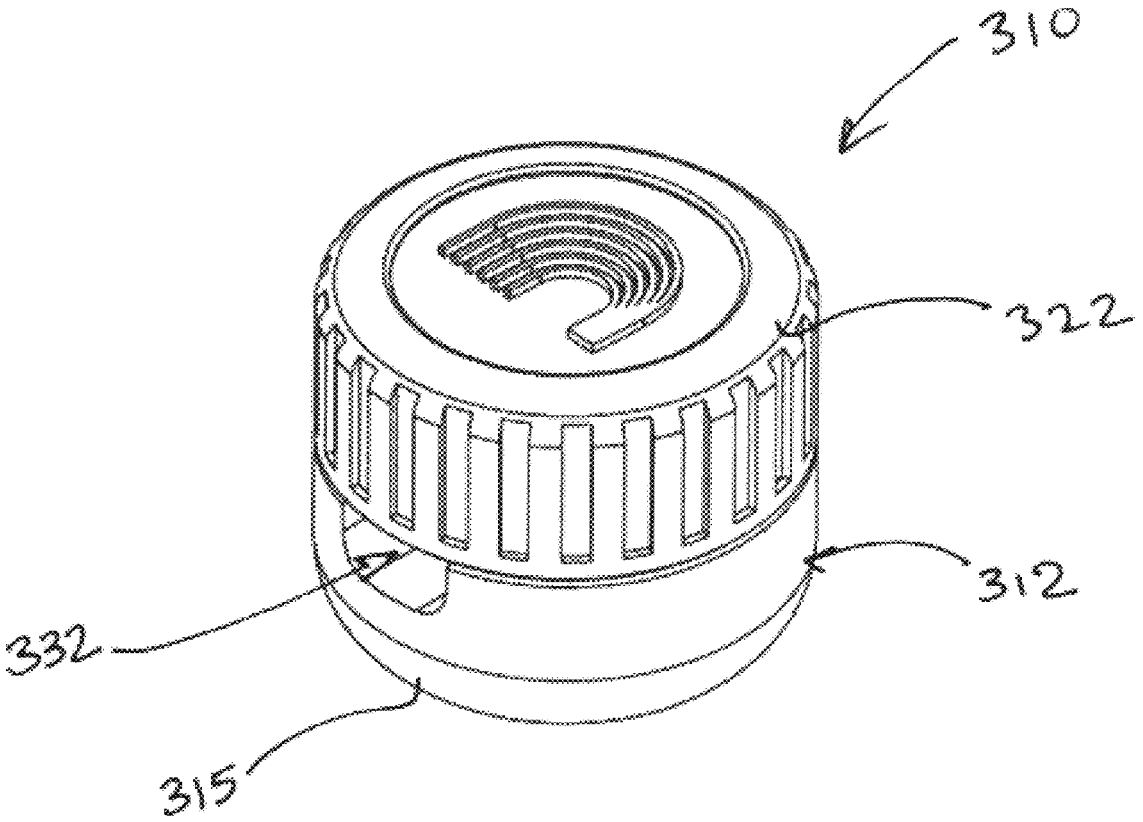
FIG. 16 shows another embodiment of an electrical unit with a light emitting unit.
Figure 17:
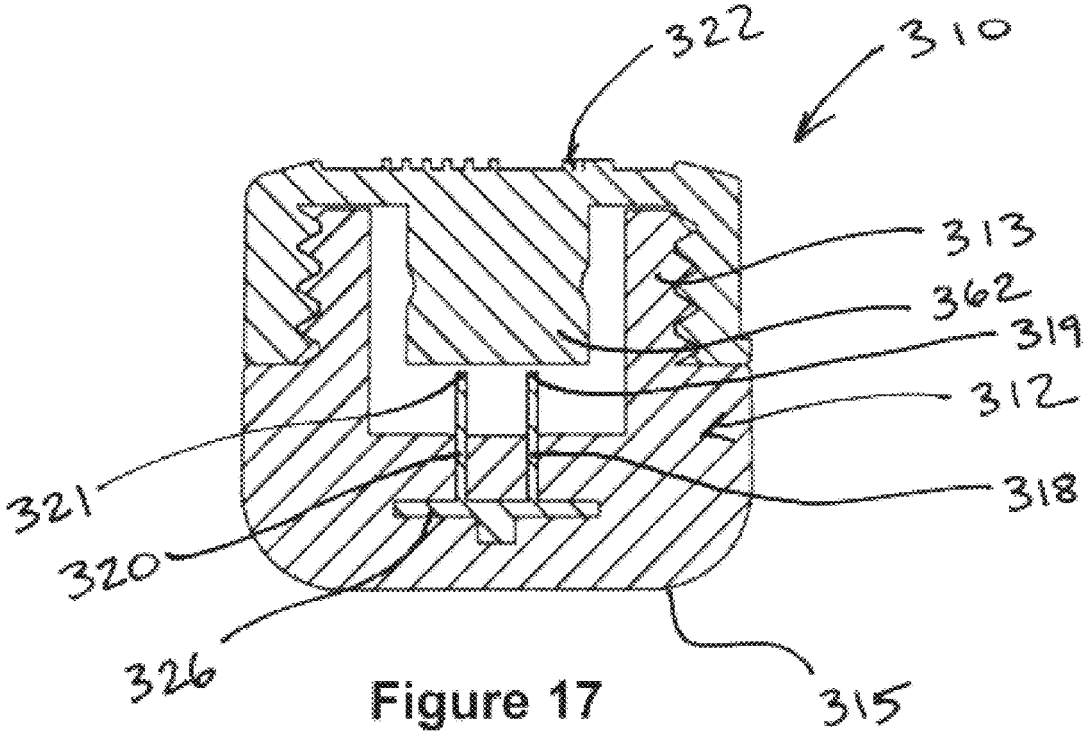
FIG. 17 is a cross-sectional view of the electrical unit of FIG. 16.
Figure 18:
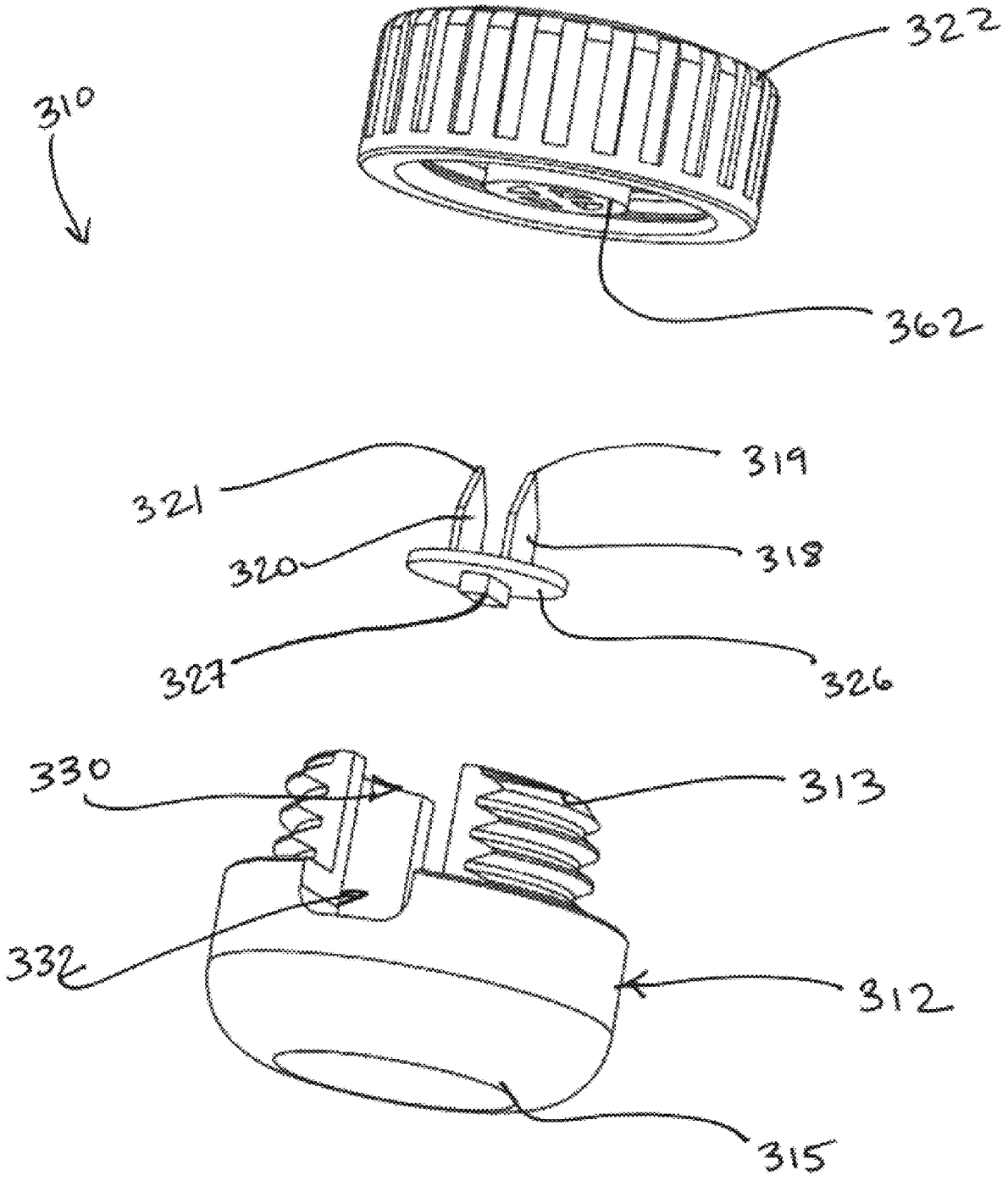
FIG. 18 is an exploded view of the electrical unit of FIG. 16.
Figure 19:
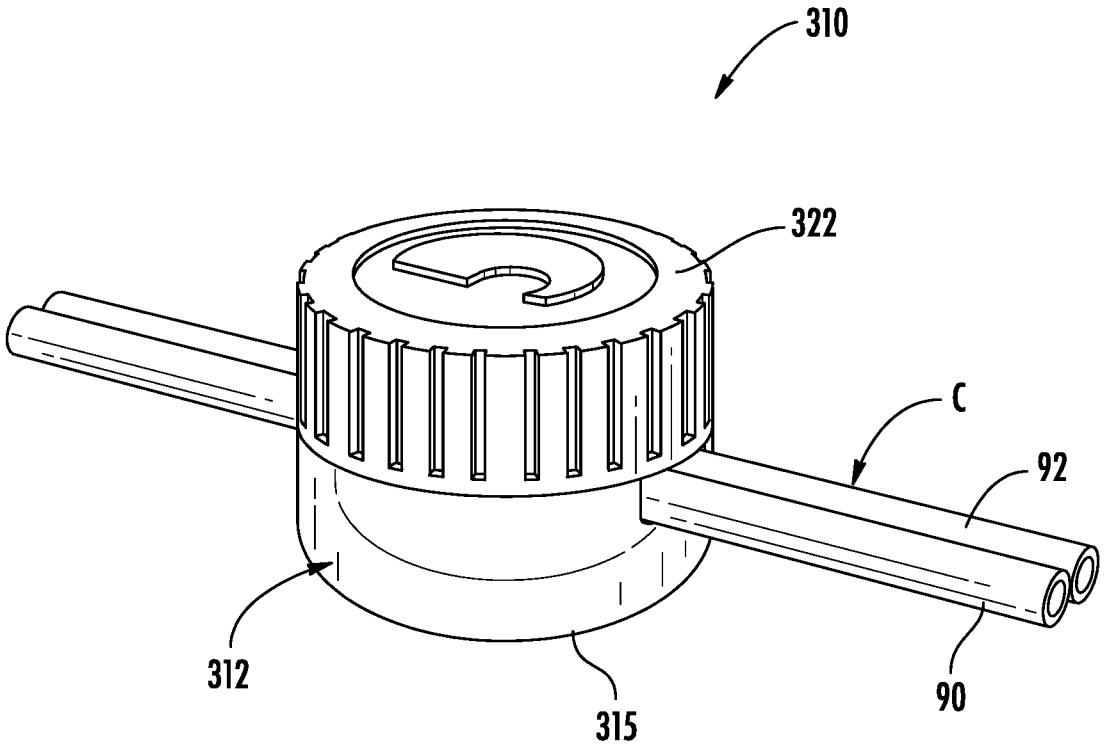
FIG. 19 is shows electrical assembly including the electrical unit of FIG. 16 engaged with a cable.

Another embodiment of a customizable electrical assembly 310 is depicted in FIGS. 16 and 17. This embodiment includes many of the unique elements and relationships present in the earlier embodiments that focus on plugs. Rather than providing a conductive pathway from a cable to plug elements, the electrical unit is used to energize a light circuit, such as the exemplary LED diode 326 shown in FIG. 16. The electrical unit 310 comprises a body 312 with an upper threaded portion 313 and an opposite lower portion 315. Also like the previous embodiments, a transversely elongate slot 330 extends through the top portion 313 to define an inner channel between a first pass-through opening 332 and a second pass-through opening 334. A cap 322 has interior threading that mates with the outer threads of the upper portion 313 to attach the cap and trap a cable C within the housing.

A first contact member 318 carries a first piercing member 319 and a second contact member 320 carries a second piercing member. Each of the piercing members, 319 and 321, extends longitudinally into a portion of the transverse channel for engagement with one of the wires of the cable. Rather than the contact members providing electrical contact through the body 312 to plug elements or similar conductors, the contact members are an integral part of an electrical element with at least one light unit 326. Further, the lower portion 315 of the body is a closed and either includes a translucent lens or is formed of a translucent material itself that allows light to pass through from the interior of the electrical unit 310. Embodiments exist with lenses or translucent bodies having different colors and/or inner light units that emit different colored light. In the depicted embodiments, the cap 322 includes a central projection 362 sized and shaped to abut and press down on the cable C when the cap is threaded to the upper portion of the body. The central projection 362 can be seen most clearly in the cross-sectional view of FIG. 17.

The body may include inner elements configured to mechanically hold and maintain the light unit 326 in a preferred position within the body, such as an annular ledge or central support/alignment members. In an alternate embodiment not depicted in FIGS. 16-19, the electrical assembly can include a removable upper insert between the cap and cable like that shown as reference numeral 24 in FIG. 2. The assembly may also include an insulator between the piercing members 319/321 and the light unit 326 through which the piercing members extend (like that of reference numeral 16 in FIG. 2). As within the previous embodiments, the insulator cradles an engaged cable and insulates the first and second contact members from one another when present.

The electrical unit 310 operates in the same manner as the earlier embodiments as well. A cable C is inserted via the top slot 310 and extends transversely through the channel defined between the pass-through openings, 332 and 334. When the cable is in a standard passthrough orientation shown in FIG. 19, the cap 322 is threaded down onto the upper portion 313. Engagement of the cap causes the central projection 362 to apply a downward force on the cable which, in turn, helps force the cable C onto the piercing members, 319 and 321, puncturing the protective cable jacket and yielding communicative contact between the inner cable wires and the contact members, 318 and 320.

Alternatively, an upper insert can be placed within the body 312 longitudinally between the cable C and the cap 322. An end electrical unit 310 in a string may be configured just like the end plugs shown in FIGS. 8 and 10. The insert above the cable is removed from the body and the terminal end of the cable is folded back into the body and trapped in place directly via the cap 322.

Electrical units 310 can be engaged at any transverse position along the cable, and optionally removed and repositioned. Additionally, an electrical system can combine a series of electrical light units 310 and an end plug unit on the cable to power the string of lights, or one or more light units 310 can be interspersed on a daisy chain of power plugs to provide light in dark settings. One of skill in the art can readily understand that the inventive combination of the body and contact members with piercing members provides a fully customizable and reusable electrical system not necessarily limited to the plug units and light units specifically shown and described herein.

Preferably, the conductive elements are formed of a conductive metal such as one or more of silver, copper, gold, tin nickel or steel, or combinations thereof. Preferred materials for the non-conductive elements include all rigid and durable inert materials, such as for example resilient polymers, thermoplastics, silicone materials and rubber.

Additionally, while the disclosed embodiments of the power plugs are described with primary reference to powering musical instrument accessories, in particular guitar effects pedals, the inventive concepts are applicable to plugs for any number of other electronic products requiring relatively low voltage, such as home theater and data center racks, LED sensors, routers, modems and wireless adaptors.

The disclosed embodiments are primarily described with reference to a standard polarity: (a) a first contact member with first piercing member (prong) communicatively engaged with a negative cable wire to provide a negative charge to an inner tube in a male plug (or central pin in a female plug); and (b) a second contact member with second piercing member (prong) communicatively engaged with a positive cable wire to provide a positive charge to an outer tube in a male plug (or outer cylinder in a female plug). However, the invention is clearly not limited as such. Within the disclosed embodiments, polarity can be reversed simply by reversing the alignment of the positive and negative wires of the cable when engaged. Additionally, the inventive concepts embodied in the plug system that is fully customizable and reusable without the requiring tools or a soldered connection is applicable to any number of different style plugs—not limited to the specific male and female connections described and shown herein as the exemplary preferred embodiments.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A customizable electrical assembly, comprising:

an elongate cable having a first wire and second wire; and an electrical plug unit comprising a body that defines a longitudinal axis extending from a first longitudinal end and a second longitudinal end and having a transverse channel that extends transversely through opposite sides, the electrical plug unit further including a plug element at the second longitudinal end of the body;

a cap engageable to the body at the first end;

a first contact member positioned within at least a portion of the body and carrying a first piercing member that extends longitudinally at least partially into the channel;

a second contact member positioned within at least a portion of the body and carrying a second piercing member that extends longitudinally at least partially into the channel, wherein the cable is engageable by the electrical unit with the cable extending transversely through the channel of the body and a first transverse section of the cable maintained within the body, wherein the first piercing member pierces the first wire and the second piercing member pierces the second wire with the cable in a longitudinal position between the cap and plug element, thereby creating communicative contact between the first wire and first contact member and between the second wire and second contact member, and the plug element is in electrical communication with the first and second contact members and is configured to engage a secondary plug or jack, thereby providing an electrical pathway from the cable to the secondary plug or jack.

2. The customizable electrical assembly of claim 1, wherein the cable is configured to be disengaged from the plug unit and re-engaged with the plug unit with the cable extending through the channel of the body with the first wire pierced by the second piercing member and the second wire pierced by the first piercing member, thereby creating communicative contact between the first wire and the second contact member and between the second wire and the first contact member.

3. The customizable electrical assembly of claim 1, wherein the first contact member extends through a portion of the body and contacts a first contact tube and the second contact member extends through a portion of the body and contacts a central pin positioned coaxial to and radially inward from the first contact tube, wherein the first contact tube is conductively insulated from the central pin.

4. The customizable electrical assembly of claim 1, wherein in the first position, the cable is folded on one of the opposite sides of the plug unit and passed back through the channel with a terminal end of first and second wires housed within the body.

5. The customizable electrical assembly of claim 1, comprising electrical circuitry defining a test circuit that provides a first notification when the first wire is a first polarity and the second wire is a second polarity and the cable is engaged, and provides a different second notification when the first wire is the second polarity and the second wire is the first polarity and the cable is engaged.

6. The customizable electrical assembly of claim 1, wherein the cable is configured to be disengaged from the electrical unit plug unit and re-engaged by the electrical unit with the cable extending through the channel of the body and a second transverse section of the cable maintained within the body, wherein the first piercing member pierces the first wire and the second piercing member pierces the second wire, thereby creating communicative contact between the first wire and first contact member and between the second wire and second contact member.

7. The customizable electrical assembly of claim 1, wherein the cap has a closed top.

8. The customizable electrical assembly of claim 1, comprising a removable insert configured to be positioned within the body on a longitudinal side of the cable toward the first longitudinal end of the body and longitudinally opposite from the first and second piercing members, wherein the insert is configured to assist trapping the cable within the housing.

9. The customizable electrical assembly of claim 8, wherein the insert is configured to be mounted within the body longitudinally between the cable and the cap.

10. The customizable electrical assembly of claim 1, wherein the first contact member extends through a portion of the body and contacts a first conductive tube, and the second contact member extends through a portion of the body and contacts a second conductive tube, wherein the first contact member and first conductive tube are electrically insulated from the second contact member and second conductive tube.

11. The customizable electrical assembly of claim 10, wherein the plug element comprises a tubular projection that extends longitudinally and defines an inner wall and an outer wall, the first conductive tube is positioned on the outer wall and the second conductive tube is positioned within the inner wall.

12. The customizable electrical assembly of claim 1, wherein the body includes an upper threaded section and the cap includes threading that mates with the upper threaded section.

13. The customizable electrical assembly of claim 12, wherein threading of the cap onto the threaded upper section causes application of a force on the cable in the longitudinal direction toward the first and second contact members.

14. A method of assembling an electrical device, comprising:

providing an electrical plug unit having a body with a channel extending transversely through the body from a first pass-through opening to a second pass-through opening at a first longitudinal end of the body, a plug element projecting longitudinally from a central section of the body in a direction opposite from the first longitudinal end of the body, a first conductive contact member positioned within the body and a second conductive contact member positioned within the body insulated from the first conductive contact member, the first contact member having a first piercing member extending longitudinally into the channel and the second contact member having a second piercing member extending longitudinally into the channel, the first and second contact members being in electrical communication with the plug element;

providing an elongate cable with a first wire and a second wire;

inserting the cable into the channel with the first wire aligned with the first piercing member and the second wire aligned with the second piercing member, the cable being positioned longitudinally between the first end and the plug element in the central section of the body;

applying a longitudinal force on (a) the first wire and second wire toward the first piercing member and second piercing member, respectively, or (b) on the first piercing member and second piercing member toward the first wire and second wire, respectively, or (c) both (a) and (b) to affect an electrical connection between the first wire and first contact member and between the second wire and second contact member to the plug element, thereby defining an engaged position of the cable;

trapping the cable within the housing in the engaged position, wherein the cable is disengage-able from the engaged position, and the plug element is engageable with a secondary plug or jack to provide an electrical pathway from the cable to the secondary plug or jack.

15. An electrical unit comprising:

a body extending longitudinally from a first end to a second end and having a slot that extends transversely relative to the longitudinal direction from a first pass-through opening to a second pass-through opening with a channel extending therebetween;

a first electrically conductive contact member positioned within at least a portion of the body having a first piercing member extending longitudinally into the channel;

a second electrically conductive contact member positioned within at least a portion of the body having a second piercing member extending longitudinally into the channel;

a cap configured to engage with the body at the first longitudinal end;

a tubular projection extending longitudinally in a direction opposite from the cap, wherein the slot is configured to receive an elongate cable having two conductive wires within the channel extending transversely through the first pass-through opening and second pass-through opening with a first section of the cable within the housing defining the first position, whereupon a longitudinal force on the cable causes the first piercing member into conductive contact with the first conductive wire to transmit a first charge through the first contact member to a portion of the tubular projection and causes the second piercing member into conductive contact with the second conductive wire to transmit a second charge through the second contact member to a portion of the tubular projection, and engagement of the cap to the body traps the cable in the first position, wherein the cable is positioned longitudinally between the cap and tubular projection.

16. The electrical unit of claim 15, wherein the body tubular projection defines an interior, comprising a first conductive tube circumscribing the tubular projection of the body and a second conductive tube interior to the tubular projection, wherein the first contact member is in conductive contact with the first tube and the second contact member is in conductive contact with the second tube, and the first contact tube is conductively insulated from the second contact tube.

17. The plug unit of claim 15, comprising a removable insert configured to be positioned within the body between the cap and the cable, wherein attachment of the cap to the body with the insert present causes the insert to press on the cable in the longitudinal direction.

18. The electrical unit of claim 15, wherein the first contact member extends through a portion of the body and contacts a first contact tube and the second contact member extends through a portion of the body and contacts a central pin positioned coaxial to and radially inward from the first contact tube, wherein the first contact tube is conductively insulated from the central pin.

19. The electrical unit of claim 15, wherein the tubular projection is defined by a wall and defines an interior, the wall having a longitudinal slot in a first location, wherein the first conductive contact member is positioned with a portion exposed from the longitudinal slot and insulated from the interior of the tubular projection.

20. The electrical unit of claim 19, wherein wall has a notch in a second location spaced from the first location, the notch being open to the interior of the tubular projection with a portion of the second conductive contact member positioned within the notch.

* * * * *